US005794692A

United States Patent [19]

Voss et al.

[11] Patent Number: 5,794,692

[45] Date of Patent: Aug. 18, 1998

[54] HEADER AND TANK CONSTRUCTION FOR A HEAT EXCHANGER

[75] Inventors: Mark G. Voss, Brighton, Mich.; Zalman P. Saperstein, Lake Bluff, Ill.; Peter C. Kottal, Racine; Gregory G. Hughes, Milwaukee, both of Wis.

[73] Assignee: Modine Manufacturing Co., Racine, Wis.

[21] Appl. No.: 144,735

[22] Filed: Oct. 28, 1993

[51] Int. Cl.[6] ..... F28F 9/02

[52] U.S. Cl. ..... 165/175; 165/153; 165/173

[58] Field of Search ..... 165/151, 153, 165/173, 175; 29/890.052, 890.043

[56] References Cited

U.S. PATENT DOCUMENTS

| | | | |
|---|---|---|---|
| 3,113,615 | 12/1963 | Huggins | 165/149 |
| 3,411,196 | 11/1968 | Zehnder | 29/890.043 |
| 4,615,385 | 10/1986 | Saperstein et al. | 165/175 |
| 4,722,387 | 2/1988 | Aurand | 165/153 |
| 5,052,480 | 10/1991 | Nakajima et al. | 165/153 |
| 5,125,454 | 6/1992 | Creamer et al. | 165/173 |
| 5,228,512 | 7/1993 | Bretl et al. | 165/153 |
| 5,320,165 | 6/1994 | Hughes | 165/153 |
| 5,329,995 | 7/1994 | Dey et al. | 165/153 |

FOREIGN PATENT DOCUMENTS

| | | | |
|---|---|---|---|
| 36497 | 2/1991 | Japan | 165/173 |
| 60485 | 3/1993 | Japan | 165/175 |

*Primary Examiner*—Leonard R. Leo

*Attorney, Agent, or Firm*—Wood, Phillips, VanSanten, Clark & Mortimer

[57] ABSTRACT

Restrictions on the major dimension of flattened tubes used in heat exchangers employing oval shaped, two piece headers/tank assemblies can be minimized in a construction including a plurality of flattened tubes (14) each having a minor dimension and a major dimension transverse thereto and extending in spaced parallel relation. Fins (16) are in heat exchange relation with the tubes (14) and a pair of spaced, parallel, elongated headers/tank assemblies (10, 12) are provided between which the tubes (14) extend. At least one of the headers/tank assemblies (10, 12) is a multiple piece header/tank assembly including a header piece (20) and a separate tank piece (22). The header piece (20) is elongated and provided with a plurality of slots (28) sized to receive ends of the tubes (14) with the tube major dimensions being generally transverse to the direction of elongation of the header piece (20). The header piece further includes a peripheral flange (24). The tank piece (22) is elongated, concave and has a peripheral flange (44) nested within the peripheral flange (22) of the header piece (20). The two are bonded together to form a unitary tubular structure and the peripheral flange (42) of the tank piece has alternating crests (52) and valleys (50) with the valleys (50) having a width greater than the tube minor dimension and being aligned with the tube ends. As a consequence, a flow to the tubes (14) is not obstructed by the peripheral flange (42) on the tank piece because of the valleys (50) therein.

14 Claims, 1 Drawing Sheet

HEADER AND TANK CONSTRUCTION FOR A HEAT EXCHANGER

SPECIFICATION

1. Field of the Invention

This invention relates to heat exchangers, and more particularly, to combined header and tank constructions usable in moderately high pressure applications as, for example, cooling systems including high pressure radiators, and air conditioners condensers and/or evaporators in vehicles.

2. Background of Invention

Recent years have seen an almost unanimous switch from conventional heat exchangers in vehicles to those of the so called parallel flow type as exemplified by commonly owned Guntly U.S. Pat. No. 4,998,580. This type of a heat exchanger has a number of advantages over more conventional types, such as being lightweight and having a low internal volume. When used in two phase heat exchange operations and provided with flow passages whose hydraulic diameters (as conventionally defined) are 0.070 inches or less, high heat exchange efficiency is also obtained.

One feature of such heat exchangers that is responsible for their relatively light weight and low charge volume is use of a combined header and tank. As disclosed in the exemplary embodiment of Guntly, cylindrical tubes serve as both headers and tanks. One side of the tube is slotted to receive the ends of flattened tubes which extend partly into the interior and are typically brazed in place to seal the flattened tube-slot interface and provide a secure assembly. The resulting low weights are highly desirable in vehicular installations because the lesser weight ultimately means that less energy will be required to propel the vehicle; and that, in turn, translates into fuel savings.

Another advantage that may be associated with heat exchangers of this type is the fact that their profile is relatively small as compared to conventional heat exchangers. For example, the use of the combined header and tank constructions of Guntly result in a heat exchanger having a lesser dimension measured transverse to the direction of elongation of the header/tank assembly than would be the case if conventional headers were used. This allows such a heat exchanger to be more readily situated in modern vehicles wherein aerodynamics are critical to achieving better fuel economy. Stated another way, because of the somewhat smaller profile afforded by these type of heat exchangers, it is easier to obtain aerodynamic "slipperiness" in a vehicle, particularly the front end of the vehicle, where the heat exchanger is being utilized as a condenser or radiator.

As noted above, in the exemplary embodiment disclosed by Guntly, the combined header and tank constructions are in the form of cylindrical tubes. The header/tank assembly to header/tank assembly dimension of the heat exchanger could be further reduced if the header and tank constructions were somewhat flattened as, for example, to tube constructions of generally oval cross section. This has been proposed in Nishishita U.S. Pat. No. 5,036,914, issued Aug. 6, 1991. In the Nishishita patent, the tubular, oval cross section header/tank assembly is made using two components to fabricate the tube. One component may be termed a header piece, which forms half of the oval and which is slotted to receive the ends of flattened tubes. The other piece is a tank piece which is also partially oval shaped and which is fitted about the header piece and brazed thereto to define a two piece tube which serves as combined header and tank. Because the minor axis of an oval is less than the major axis, it will be appreciated that one dimension of the header and tank construction may be reduced through this method such that the header/tank assembly to header/tank assembly dimension of a heat exchanger can be reduced over that of an otherwise identical heat exchanger employing cylindrical tubes as header and tank constructions.

One substantial problem with a Nishishita header/tank assembly resides in the fact that the slots are in the header section about which the tank section is fitted. This necessarily limits the length of the slots, and thus the tube major dimension of the flattened tubes used in the heat exchanger. Specifically, the slots cannot be any longer than the width of that part of the header piece that is visible from the open side of the tank piece, unless one goes through the additional costly steps of forming parts of the slots in the tank piece as well, and then aligning the partial slots in the tank piece with the slots in the header piece. Limitations on tube major dimension may result in undesirably high pressure drops on the heat exchange fluid flowing within the heat exchanger which can reduce heat exchange efficiency, increase energy costs, etc.

The present invention is directed to overcoming one or more of the above problems.

SUMMARY OF THE INVENTION

It is a principal object of the invention to provide a new and approved head exchanger. More specifically, it is an object of the invention to provide a new and improved, multiple piece header/tank assembly for a heat exchanger.

An exemplary embodiment of a heat exchanger made according to the invention achieves the foregoing objects in a structure including a plurality of flattened tubes, each having a minor dimension and a major dimension transverse thereto. The tubes extend in spaced, parallel relation and fins are disposed between the tubes and in heat exchange relation therewith. A pair of spaced, parallel elongated headers/tank assemblies is provided. The tubes extend between the headers/tank assemblies and at least one of the headers/tank assemblies is a multiple piece header including a header piece and a separate tank piece. The header piece is elongated and has a plurality of slots sized to receive the ends of the tubes with the tube major dimensions being generally transverse to the direction of elongation of the header piece. The header piece further includes a peripheral flange. The tank piece is also elongated and concave and has a peripheral flange nested within the peripheral flange of the header piece and bonded thereto to form a unitary tubular structure. The peripheral flange of the tank piece is provided with alternating crests and valleys with the valleys having a width greater than the tube minor dimension and being aligned with the tube ends. Consequently, flow to the tubes is not obstructed by the peripheral flange on a tank piece because of the valleys in such peripheral flange being aligned with the tube ends to provide reliefs therefor.

In one embodiment, the crests of the peripheral flange of the tank piece abut the header piece.

In one preferred embodiment, the crests and valleys define a castellated edge on the peripheral flange of the tank piece.

In a highly preferred embodiment, the valleys clear the tube ends by at least a few thousandths of an inch.

In one embodiment, convex domes in the form of continuous compound curves are located between each of the slots along the length of the header piece.

Preferably, the slots extend substantially completely between opposite parts of the peripheral flange of the header piece.

In a preferred embodiment, the headers/tank assemblies are of generally oval cross section.

Other objects and advantages will become apparent from the following specification taken in connection with the accompanying drawings.

DESCRIPTION OF THE PREFERRED EMBODIMENT

Figure 1:
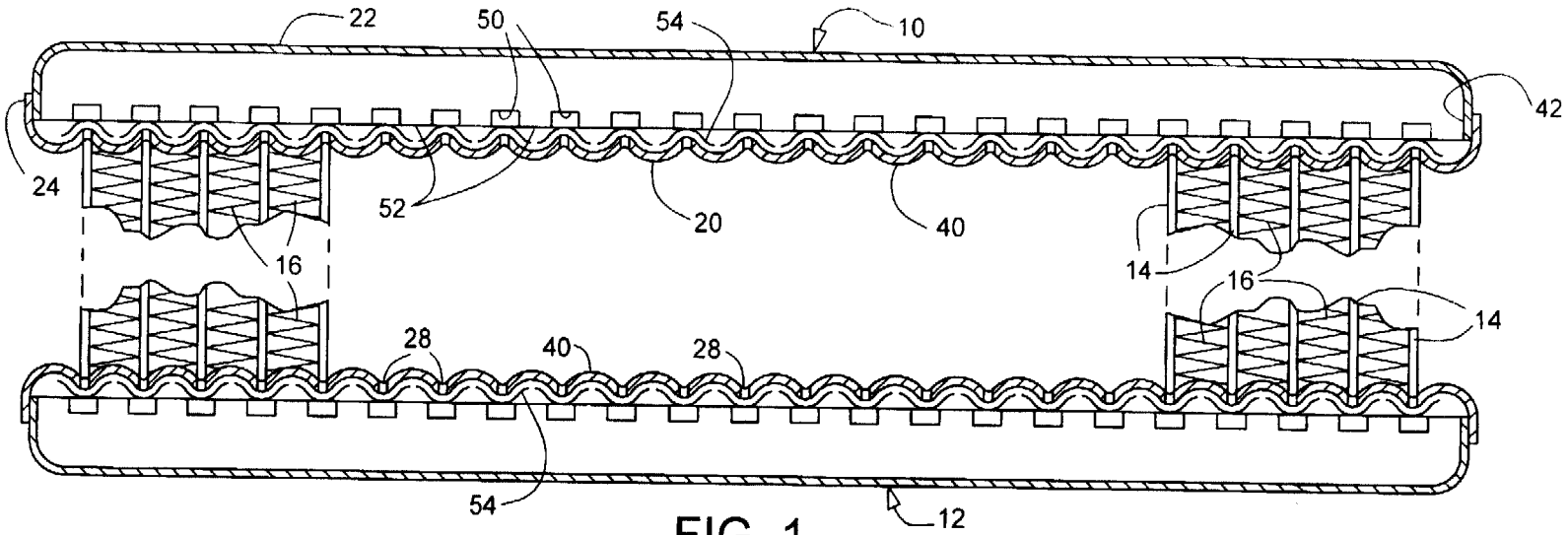
FIG. 1 is a fragmentary, sectional view of a heat exchanger made according to the invention and illustrating the headers/tank assemblies of the invention in cross section as they would appear if taken as a section approximately along the line 1—1 in FIG. 2.

An exemplary embodiment of a heat exchanger made according to the invention is illustrated in the drawings. In the usual case, the same will be intended for moderately high pressure operation as, for example, as a condenser or an evaporator in a refrigeration or air conditioning system, or even as a radiator in a relatively high pressure engine cooling system. Most usually, the heat exchanger will find use in a vehicular application, but the invention is not so limited. For example, the heat exchanger could be used for the purposes mentioned previously where the systems are stationary.

Referring to FIG. 1, the heat exchanger includes a first header/tank assembly, generally designated 10, which is elongated and a second, elongated header/tank assembly, generally designated 12. The header/tank assembly 10 is parallel to the header/tank assembly 12 and spaced therefrom.

A plurality of tubes 14 of flattened cross section extend between the headers/tank assemblies 10 and 12 and are in fluid communication with the interiors thereof. Serpentine fins 16 are located between and bonded to adjacent ones of the tubes 14. Needless to say, various fittings (not shown) to provide ports, baffles, etc. for the headers 10, 12 are included in the assembly. In the usual case, the entire heat exchanger will have its various components assembled to each other as by brazing.

In the exemplary embodiment of the invention, the headers/tank assemblies 10 and 12 are identical, one to the other. Consequently, only the header/tank assembly 10 will be described. In the preferred embodiment, the header/tank assembly 10 is made up of two components. One is a header piece 20 and the second is a tank piece 22. The header piece 20 includes a peripheral flange 24 surrounding a partial oval surface 26. Within the oval surface 26 there are provided a plurality of tube slots 28 which receive the ends of the tubes 14.

Figure 4:
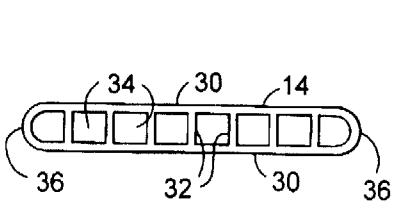
FIG. 4 is an enlarged, sectional view of a flattened tube used in making the heat exchanger.

A cross section of a typical tube is illustrated in FIG. 4 and the same is seen to include flat walls 30 to which the fins 14 are bonded, and interior webs 32 defining a plurality of interior passages 34, preferably of a hydraulic diameter of 0.07 inches or less if the heat exchanger is to be used in a refrigeration or air conditioning application. As is well known, the distance between the flat sides 30 is referred to as the tube minor dimension and the dimension of the tube transverse thereto, that is, extending between ends 36, is referred to as a tube major dimension.

Returning to the slots 28, the same are transverse to the direction of elongation of the header/tank assembly 10 and are configured to have a shape and size virtually identical to the cross section of the tubes 14. Thus, the ends of the tubes 14 may be snugly received in the slots 28.

Figure 2:
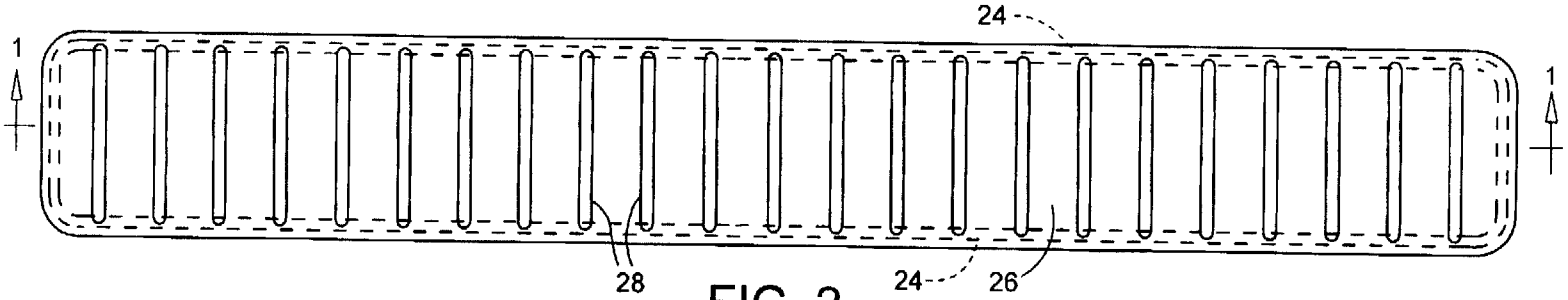
FIG. 2 is a plan view of one of the headers/tank assemblies from the header piece side thereof.

In the usual case, the exterior surface of both the header piece 20 and the tank piece 22 are provided with braze cladding. Because the slots 28 are formed as illustrated in FIGS. 1 and 2, that is, by being directed into the oval surface 26, it will be appreciated that braze clad will be adjacent each of the slots 28 to unite with tubes 14 in a brazing operation.

Figure 3:
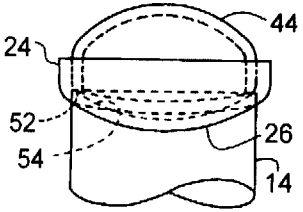
FIG. 3 is a fragmentary, side elevation of one of the headers/tank assemblies.

Also of significance, is the fact that the area between each of the slots 28, along the entire length of the header/tank assembly 10, is provided with domes 40. As can be seen in FIG. 1, each dome 40 has a curved cross section extending continuously between adjacent ones of the slots 40 in the direction of elongation of the header/tank assembly 10. As can be seen in FIG. 3, the surface 26 is also in the form of a curve that extends continuously between opposite sides of the peripheral flange 24. Thus, each of the domes 40 is in the form of a continuous compound curve. The use of such domes enhance the pressure resistance of the ultimate heat exchanger by minimizing the flexure of the header piece 20 in response to pressure in the vicinity of the tube to header joints established between the headers/tank assemblies 10 and 12 and the ends of the tubes 14.

As can be seen in FIG. 1, the tank piece 22 also includes a peripheral flange 42. The peripheral flange 42 is nested snugly within the flange 24 and bonded thereto. To this end, braze clad is located on the surface 26 of the header piece 20 as well as the exterior surface 44 of the tank piece 22. It will also be appreciated from FIG. 3 that the tank piece 22 is of concave configuration.

As can be seen in FIG. 1, the edge of the flange 42 of the tank piece 22 is castellated. That is to say, the same includes a plurality of valleys 50 separated by crests 52 such that the resulting configuration looks somewhat like a square wave. It will also be observed that the valleys 50 are of a width in the direction of elongation of the header/tank assembly 10 that is greater than the minor dimension of the tubes 14 at their ends. In one embodiment, the width of the valleys 50 is three times greater than the tube minor dimension although it is not necessary that such a relationship be maintained. It is only necessary that the valleys 50 be somewhat wider than the tube minor dimensions.

The crests 52 are in abutment with the interior surface 54 of the header piece 40 along the entire length thereof. This abutment establishes the interior volume between the pieces 20 and 22.

As a result of this configuration, it will be immediately appreciated from FIG. 2 that the slots 28 may extend the entire distance between opposite parts of the flange 24 of the header piece 20 that is plainly evident in FIG. 2. This allows one to use tubes 14 having the largest possible tube major dimension without increasing the cross sectional profile transverse to the direction of elongation of each header/tank assembly, and still avoid problems with pressure drops on the interior. In particular, valleys 50 serve as reliefs about the ends of the tubes 14 as they are received within the slots 28 and brazed thereto. Significantly, the depths of the valleys 50 only need such that a few thousandths of an inch clearance exists between the ends of the tubes 14 to the edge of the flange 42, depending upon the brazed materials being used.

A major point of the use of the valleys 50 is to prevent, during the braze process, liquid braze metal at the interface between the flanges 24 and 42 from flowing onto the open ends of the tubes 14 and sealing one or more of the passages 34 therein.

To achieve this, it will be appreciated that the precise castellated configuration illustrated in the drawings need not necessarily be employed to achieve the same result. For example, rather than the illustrated square wave shape, a half sine wave shape or even a saw tooth shape could be employed to achieve the same results.

In any event, as a consequence of this construction, the tube major dimension may be maximized for any header/tank assembly of a given width to achieve the benefits afforded by the use of tubes having large major dimensions. At the same time, the advantages of a two piece, oval cross section header/tank assembly in terms of providing a reduced profile header/tank assembly are retained.

We claim:

1. A heat exchanger comprising a plurality of flattened tubes, each having a minor dimension and a major dimension transverse thereto, extending in spaced parallel relation;

fins between and in heat exchange relation with said tubes; and a pair of spaced parallel elongated headers/tank assemblies between which said tubes extend, at least one of said headers/tank assemblies being a multiple piece header including a header piece and a separate tank piece, said header piece being elongated and having a plurality of slots sized to receive ends of said tubes with the tube major dimensions being generally transverse to the direction of elongation of said header piece, said header piece further including a peripheral flange, said tank piece being elongated, concave and having a peripheral flange nested within the peripheral flange of said header piece and bonded thereto to form a unitary tubular structure, the peripheral flange of the tank piece having alternating crests and valleys, said valleys having a width greater than said tube minor dimension and being aligned with said tube ends;

whereby flow to said tubes is not obstructed by said tank piece peripheral flange because of the valleys therein being aligned with said tube ends to provide reliefs therefor.

2. The heat exchanger of claim 1 wherein said crests abut said header piece.

3. The heat exchanger of claim 2 wherein said crests and valleys define a castellated edge on said tank piece peripheral flange.

4. The heat exchanger of claim 1 wherein said valleys are such that at least a few thousandths of an inch clearance exists between the tube ends.

5. The heat exchanger of claim 1 wherein there are convex domes in the form of continuous compound curves between each of said slots along the length of said header piece.

6. The heat exchanger of claim 1 wherein said slots extend substantially completely between opposite parts of said header piece peripheral flange.

7. The heat exchanger of claim 1 wherein said headers/tank assemblies are of generally oval cross section.

8. The heat exchanger of claim 1 wherein said header and tank pieces, said fins and said tubes are brazed together.

9. A heat exchanger comprising a plurality of flattened tubes, each having a minor dimension and a major dimension transverse thereto, extending in spaced parallel relation;

fins between and in heat exchange relation with said tubes; and a pair of spaced parallel elongated headers/tank assemblies between which said tubes extend, at least one of said headers/tank assemblies being a multiple piece header including a header piece and a separate tank piece, said header piece being elongated and having a plurality of slots sized to receive ends of said tubes with the tube major dimensions being generally transverse to the direction of elongation of said header piece, said header piece further including opposed elongated flanges extending along its length, said tank piece being elongated, concave and having opposed elongated flanges extending along its length and nested within the flanges of said header piece and bonded thereto to form a unitary tubular structure, the flanges of the tank piece having alternating crests and valleys, said valleys having a width greater than said tube minor dimension and being aligned with said tube ends;

whereby flow to said tubes is not obstructed by said tank flanges because of the valleys therein being aligned with said tube ends to provide reliefs therefor.

10. The heat exchanger of claim 9 wherein said crests abut said header piece.

11. The heat exchanger of claim 10 wherein said crests and valleys define a castellated edge on said tank piece peripheral flange.

12. The heat exchanger of claim 9 wherein said opposed elongated flanges on said header piece define part of a peripheral flange thereon and said tank piece is rested within said peripheral flange.

13. The heat exchanger of claim 9 wherein said opposed elongated flanges on said tank piece define part of a peripheral flange thereon and said tank piece peripheral flange is nested between said header piece elongated flanges.

14. A heat exchanger comprising:

a plurality of flattened tubes, each having a minor dimension and a major dimension transverse thereto, extending in spaced parallel relation;

fins between and in heat exchange relation with said tubes; and a pair of spaced parallel elongated header/tank assemblies between which said tubes extend, at least one of said header/tank assemblies being a multiple piece header including a header piece and a separate tank piece, said header piece being elongated and having a plurality of slots sized to receive ends of said tubes with the tube major dimensions being generally transverse to the direction of elongation of said header piece, said header piece further including opposed, elongated flange sections extending along its length, said tank piece being elongated, concave and having opposed elongated flange sections extending along its length and nested within the flange section of said header piece and bonded thereto to form a unitary tubular structure, the flange sections of the tank piece having alternating crests and valleys, said valleys having a width greater than said tube minor dimension and being aligned with said tube ends;

whereby flow to said tubes is not obstructed by said tank flange sections because of the valleys therein being aligned with said tube ends to provide reliefs therefor.

* * * * *

UNITED STATES PATENT AND TRADEMARK OFFICE

CERTIFICATE OF CORRECTION

PATENT NO. : 5,794,692

DATED : August 18, 1998

INVENTOR(S) : Voss et al.

It is certified that error appears in the above-indentified patent and that said Letters Patent is hereby corrected as shown below: On the title page: Item [75] should read Inventors: Mark G. Voss, Brighton, Mich.; Zalman P. Saperstein, Lake Bluff, Ill.; Peter C. Kottal, Racine; Gregory G. Hughes, Milwaukee; Robert L. Anderson, Franksville; James T. Haasch, Bay View, all of Wis.

Signed and Sealed this

Seventeenth Day of August, 1999

*Attest:*

Q. TODD DICKINSON

*Attesting Officer*

*Acting Commissioner of Patents and Trademarks*